US008915747B2

(12) United States Patent
Chawla et al.

(10) Patent No.: US 8,915,747 B2
(45) Date of Patent: Dec. 23, 2014

(54) CONNECTOR ASSEMBLY WITH INTEGRATED PITCH TRANSLATION

(71) Applicant: Intel Corporation, Santa Clara, CA (US)

(72) Inventors: Gaurav Chawla, Tempe, AZ (US); Rajasekaran Raja Swaminathan, Tempe, AZ (US); Donald T. Tran, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 34 days.

(21) Appl. No.: 13/826,998

(22) Filed: Mar. 14, 2013

(65) Prior Publication Data

US 2014/0273555 A1 Sep. 18, 2014

(51) Int. Cl.
*H01R 12/00* (2006.01)
*H01R 12/71* (2011.01)

(52) U.S. Cl.
CPC ..... *H01R 12/71* (2013.01)
USPC ..... 439/79; 439/891

(58) Field of Classification Search
USPC ..... 439/68–70, 78, 79, 884, 891
See application file for complete search history.

(56) References Cited

U.S. PATENT DOCUMENTS

| | | | | |
|---|---|---|---|---|
| 5,877,944 | A * | 3/1999 | Onizuka | 361/826 |
| 6,773,287 | B2 * | 8/2004 | Takashita | 439/260 |
| 7,083,455 | B1 * | 8/2006 | Miura et al. | 439/260 |
| 7,661,972 | B2 * | 2/2010 | Okamura et al. | 439/260 |
| 8,342,869 | B2 * | 1/2013 | Okamura | 439/260 |

* cited by examiner

*Primary Examiner* — Khiem Nguyen
(74) *Attorney, Agent, or Firm* — Schwegman Lundberg & Woessner, P.A.

(57) ABSTRACT

This disclosure relates generally to a connector assembly. Optionally, first conductive members form a first row. Second conductive members include a first subset forming a second row and a second subset forming a third row, the second and third rows being parallel and offset with respect to one another. Individual ones of the first and second conductive members are arranged to be coupled at a first end to a corresponding contact. At least one of the first and second subsets has a vertical displacement to form a common row of the second conductive members at a second end of the second conductive members. Individual ones of the first conductive members are arranged to be coupled proximate a second end of the first conductive members to the second end of a corresponding one of the second conductive members.

19 Claims, 7 Drawing Sheets

CONNECTOR ASSEMBLY WITH INTEGRATED PITCH TRANSLATION

TECHNICAL FIELD

The disclosure herein relates generally to a connector assembly with integrated pitch translation.

BACKGROUND ART

Electronic packages have long utilized a variety of modes for transmitting and receiving information between a die contained within the package and electronic devices outside of the package. Electrical interconnects provide electrical connectivity within the package between the die and the various communication components that can be utilized to transmit and receive electronic signals from and to the die. One such communication component is a conventional socket-connected solder bump, configured to create a physical electrical connection between the package and another electronic device that via a motherboard or other circuit board. Another such communication component is a cable connector that permits communication between the die and an external electronic device without respect to a motherboard.

DESCRIPTION OF THE EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Conventionally, communication via a circuit may provide for relatively small size requirements for the communication interface in comparison with cable connection. Circuit board-based communication may utilize half or less of the space on a chip package to provide the physical interface for the electrical connection than conventional cable communication. However, certain uses of chip packages on circuit boards has resulted in circuit boards becoming relatively crowded, limiting the potential for placing additional electronic communication lines within the circuit board. Additionally, the electronic communication lines in a circuit board may be relatively slow in comparison with certain cable communication lines, such as coaxial cables.

However, while cable communication lines, such as coaxial cables, provide advantages in data rate and avoiding crowding on circuit boards, certain cables, including coaxial cables, are also relatively thick. Factoring in both the communicative element and insulation, a pitch between adjacent cables can be two or more times greater than the minimum pitch of the connectors on the chip package to which the cables may be connected. In other words, while the connectors on the chip package may be designed with fabrication technology that would permit a certain minimum pitch, the characteristics of contemporary cables may result in the connectors on the chip package necessarily being spaced with a pitch larger than the minimum pitch in order to provide enough space to couple with the cables.

A connector assembly has been developed that allows for the use of both relatively high-gauge cables as well as low-pitch connectors on a chip package. The connector assembly utilizes a pitch translation that permits a first pitch on the chip package and a second, larger pitch on the cable side. The connector assembly may include a connector that translates from multiple rows to a single row, may provide for ninety (90) degree directional translation, and may be horizontally coupleable between individual connectors of the connector assembly.

Figure 1:
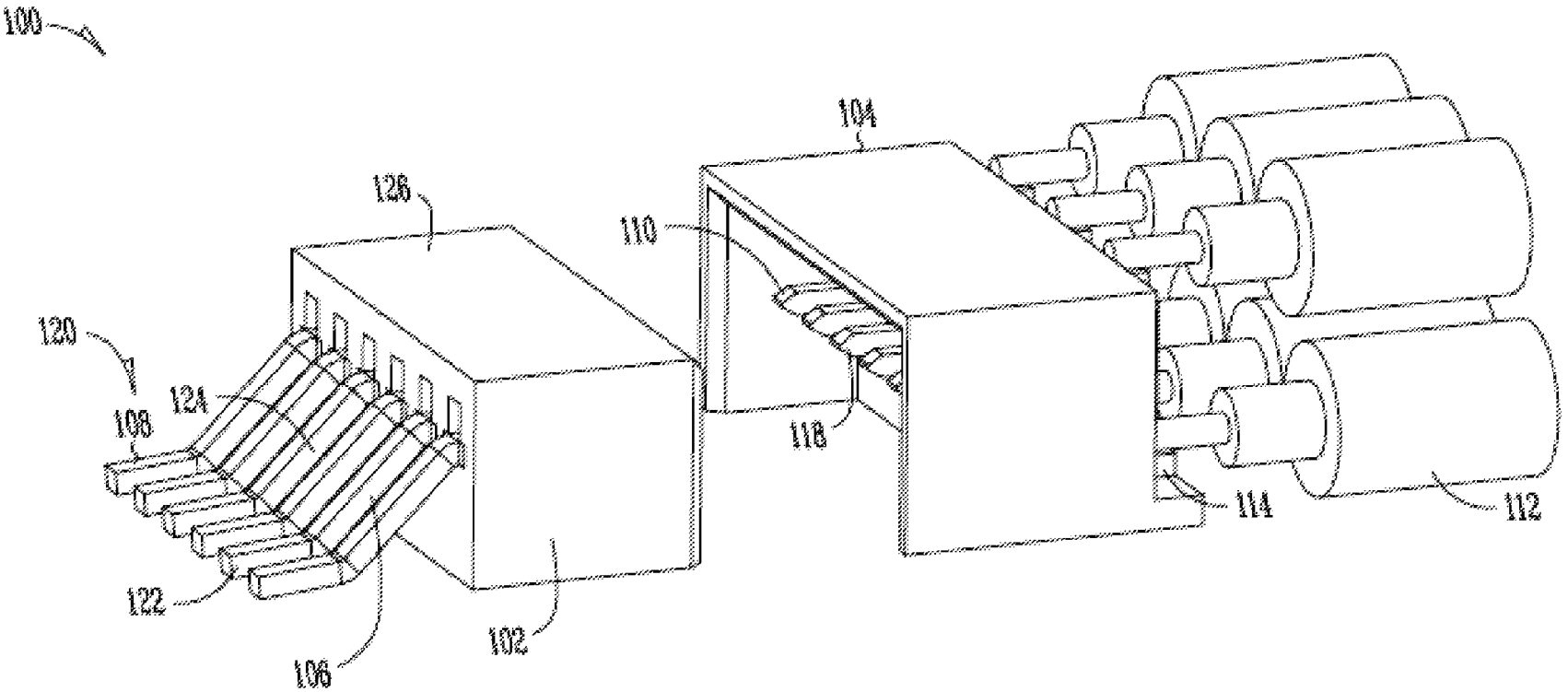
FIG. 1 is an image of a connector assembly.

FIG. 1 is an image of a connector assembly 100. The connector assembly 100 includes a chip package-side connector 102 and a cable-side connector 104. The package-side connector 102 includes first conductive members 106 secured with respect to one another by and extending through the package-side connector 102. The conductive members 106 are configured to electrically couple at a first end 108 with connectors on a chip package (not pictured). The cable-side connector 104 includes second conductive members 110 that are secured with respect to one another by the connector 104 and that are each coupled to a cable 112 at a first end 114 of the conductive members 110.

The first and second conductive members 106, 110 are configured to electrically couple to one another at interface surfaces proximate the second ends 116 (obscured, see FIG. 2A, 2B), 118 of the conductive members 106, 110, respectively. As illustrated, the connectors 102, 104 are configured to mechanically engage with one another. Upon the connectors 102, 104 being mechanically engaged, various conductive members 106, 110 mechanically and electrically engage with respect to one another, creating electrical connectivity between a chip package connector and a corresponding one of the cables 112.

As illustrated, the second connector 104 is configured to horizontally engage with the first connector 102. In various examples, second connector 104 is configured to slidably engage with the first connector 102. In such an example, an overhead component or other obstruction may not interfere with the engagement between the first and second connectors 102, 104.

As will be detailed herein, the first conductive members 106 are substantially contained within a first row 120, such as that extends generally vertically from the chip package. Stated another way, in an example, the first conductive members 106 include a vertical displacement in relation to a surface of a chip package. The illustrated example includes an optional first horizontal component 122 that may be electrically and mechanically coupled to an electrical contact on the chip package. The first horizontal component 122 may be horizontal or slightly angled (e.g., ten (10) degrees) in relation to a major surface of a chip package or other surface in relation to which the connector 102 is mounted. The illustrated example further includes an angled component 124 configured to provide vertical displacement of the first conductive member 106 from the surface of the chip package. As will be detailed herein, various additional examples may provide for alternative configurations of the first conductive members 106 and the connector 102 generally. In further examples, the housing 126 of the connector 102 may extend to completely or substantially enclose the conductive members 106.

Figure 2A:
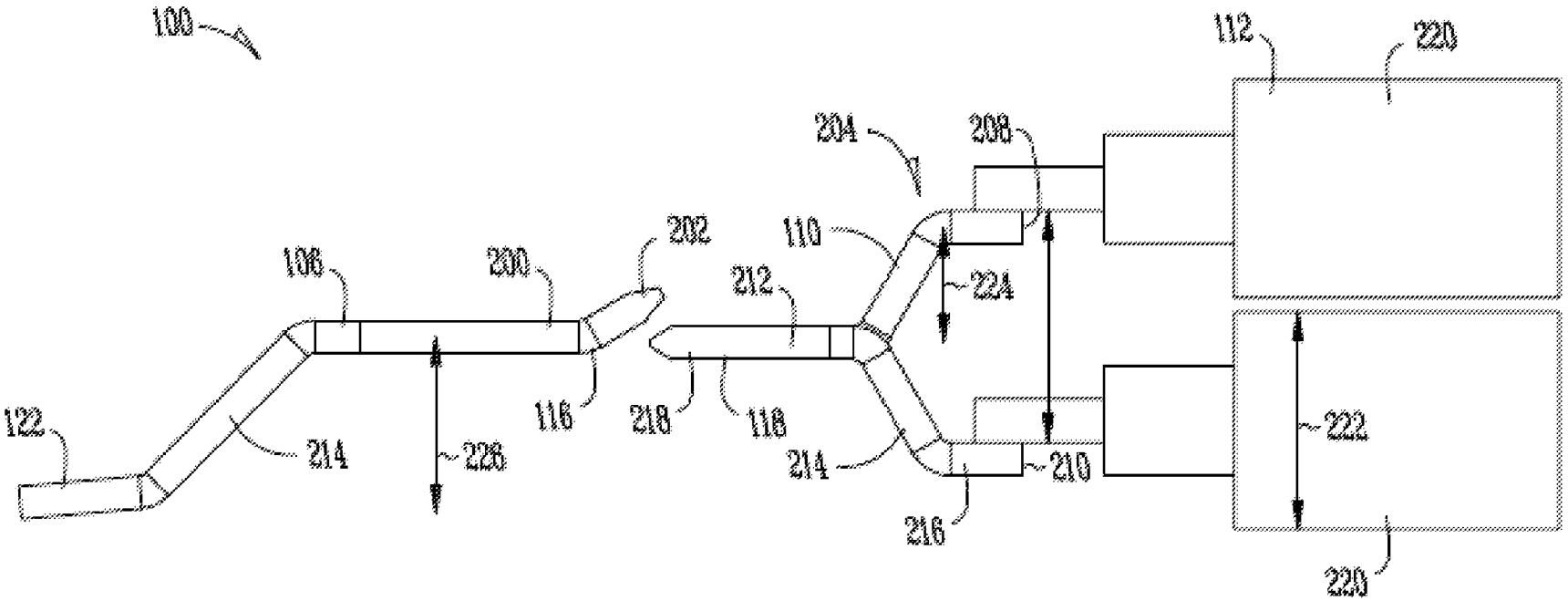
FIGS. 2A and 2B are an end-on view and a perspective tear-away view of a connector assembly, respectively.
Figure 2B:
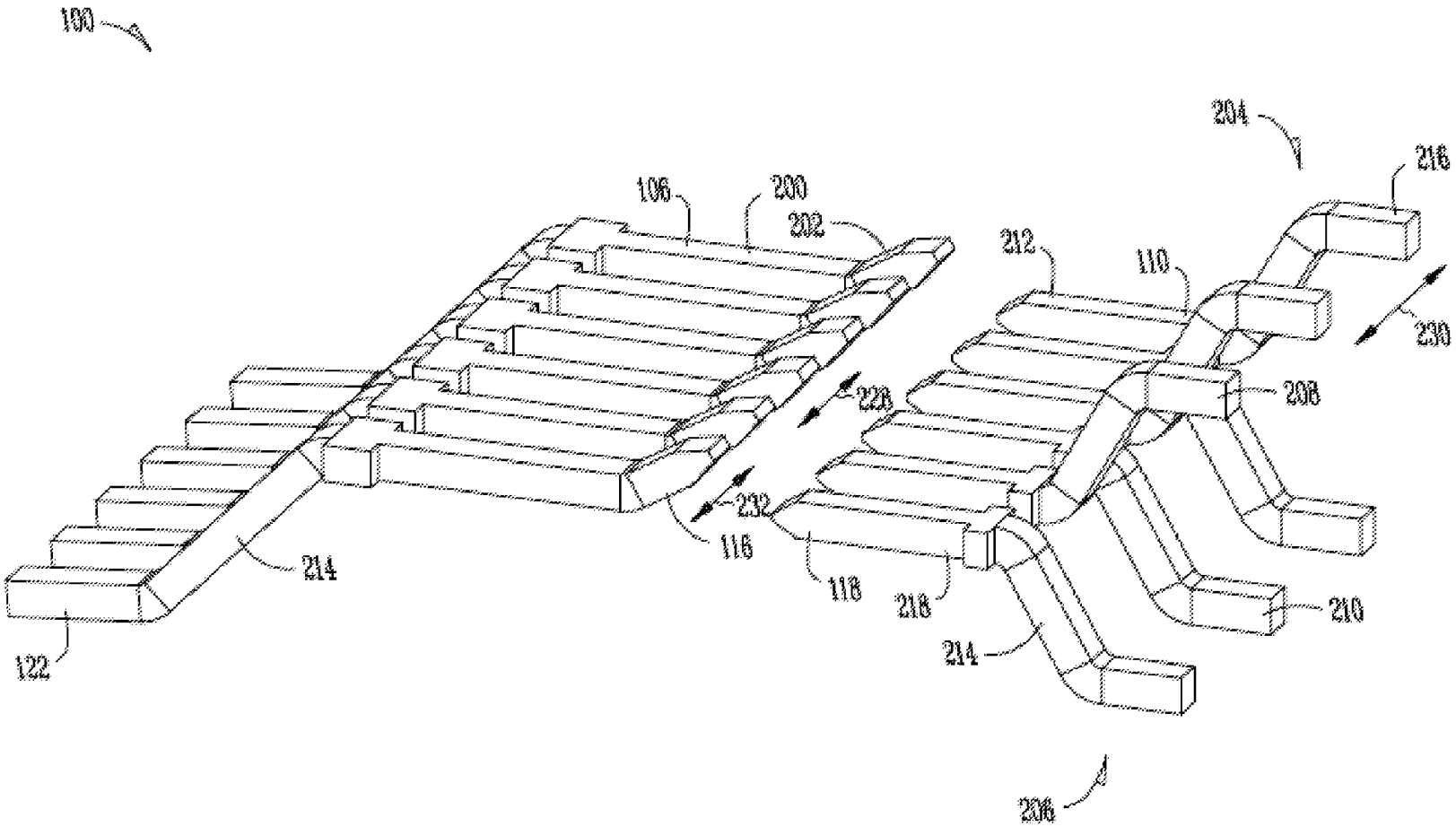

FIGS. 2A and 2B are a side and perspective profile of the first and second conductive members 106, 110 of the connector assembly 100. FIG. 2A further includes the cable 112.

In the illustrated example, the first conductive member 106 further includes a second horizontal component 200. The second horizontal component 200 may be substantially parallel to the first horizontal component 122 or may be slightly angled (e.g., ten (10) degrees) in relation to the first horizontal component 122. In the illustrated example, the first conductive member 106 further includes an engagement component 202 at the second end 116, configured to mechanically and electrically engage with the second end 118 of the second conductive member 110.

Each of the second conductive members 110 are part of one or the other, but not both, of a first and second subset 204, 206, respectively of the second conductive members 110. The first and second subsets 204, 206 respectively form a second cable-side row 208 and a third cable-side row 210. The first and second subsets 204, 206 merge at a common row 212 that extends to the second end 118 of the second conductive members 110.

In the illustrated example, each of the second conductive members 110 includes an angled component 214 that produces vertical displacement between the first end 114 and the second end 118. The first and second horizontal components 216, 218 at the first and second ends 114, 118, respectively, provide for an interface with the cable 112 and the second end 116 of the first conductive members 106.

In various examples of both the first and second conductive members 106, 110, the angled components 124, 214 and horizontal components 122, 200, 216, 218 are optionally replaced with or supplemented by vertical components dependent on design preferences and the conditions in which the connector assembly 100 is utilized. In various examples, the use of angled components 124, 214 may provide relatively shorter conductive members 106, 110 with relatively less signal loss. The user of vertical components may provide for relatively simpler manufacture over angled components.

As illustrated with respect to FIG. 2A, the cable 112 includes individual members 220 that separately couple to individual second conductive members 110. In the illustrated cable 112, the members 220 are on two non-overlapping rows, providing a cable 112 height 222 of at least double the thickness of the members 220. In alternative examples, individual members may be nested with respect to one another and thus have overlapping rows. In such an example, the height 222 of the cable 112 may be less than double the thickness of the individual members 220.

In an example, the thickness of the individual cable members 220 is approximately one (1) millimeter. In an example, the thickness 222 of the cable 112 is approximately 1.05 millimeters. In an example, the vertical displacement 224 between second conductive members 110 of different subsets 204, 206 is approximately half of 1.05 millimeters (i.e., approximately 0.525 millimeters, though tolerances of particular processes may or may not support 0.005 millimeter precision). In an example, the vertical displacement 226 of the first conductive member, such as is induced by the angled component 124, is approximately one (1) millimeter.

The pitch of the first conductive members 106 may be defined as a distance 228 between adjacent first conductive members 106. The pitch of the second conductive members 110 at the second end 118 may be defined as the distance 230 between adjacent second conductive members 110 of the same subset 204, 206. The pitch of the second conductive members 110 at the first end 114 may be defined as the distance 232 between adjacent second conductive members 110 and may be essentially the same as the pitch of the first conductive members 106.

It is to be understood that examples may scale to incorporate more rows of the conductive members 106, 110. For instance, the second conductive members 110 may include a third subset that forms a fourth row, such as that is above the second and third rows 208, 210, that combine with the second and third rows 208, 210 to form the common row 212. Additional rows and subsets may be included. Additionally, the first conductive members 106 may form two or more rows, such as that include a vertical displacement to form a common row with all of the first conductive members that may interface with the common row 212 of the second conducive members.

FIGS. 3A-3F are abstract illustrations of alternative configurations of connector assemblies. The connector assemblies 100 and 100A-F incorporate various alternative architectures, but may have in common that the second conductive members have two rows 208, 210 at the first end 114 and one common row 212 at the second end 118. The conductor assemblies 100 and 100A-F may further have the common characteristic that the first and second connectors 102, 104 (as depicted in FIG. 1) are horizontally engageable and, in various examples, are slidably horizontally engageable. The conductor assemblies 100 and 100A-F may further have the common characteristic of ninety (90) degree translation. It is to be noted that the conductor assemblies 100A-F are illustrative and non-limiting. Alternative conductor assemblies may selectively incorporate or not incorporate various characteristics disclosed herein.

Figure 3A:
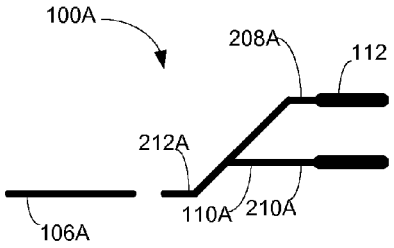
FIGS. 3A-3F are abstract illustrations of configurations of connector assemblies.

FIG. 3A illustrates a connector assembly 100A with no vertical displacement of the first conductive members 106A. In addition, the rather than being approximately equidistance between the second and third rows 208A, 210A, the common row 212A is lower than both the first and second rows 208A, 210A so as to engage the second conductive members 110A with the first conductive members 106A.

Figure 3B:
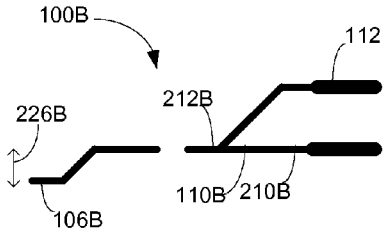

FIG. 3B illustrates a connector assembly 100B with the common row 212B being coincident with the third row 210B. In such an example, the vertical displacement 226B of the first conductive members 106B is sufficient to engage with the second conductive members 110B at the common row 212B.

Figure 3C:
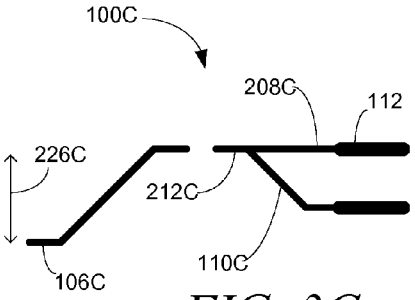

FIG. 3C illustrates a connector assembly 100C with the common row 212C being coincident with the second row 208C. In such an example, the vertical displacement 226C of the first conductive members 106C is sufficient to engage with the second conductive members 110C at the common row 212C.

Figure 3D:
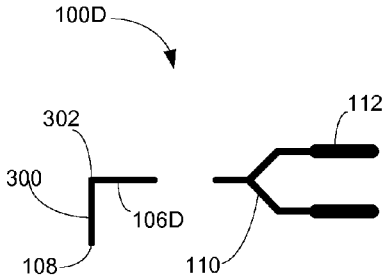

FIG. 3D illustrates a connector assembly 100D with the first conductive members 106D having a vertical component 300, a ninety (90) degree bend 302, no angled component, and no first horizontal component. In such an example, the first end 108 of the first conductive member 106D is at the end of the vertical component 300. As illustrated, the second conductive members 110 are unchanged. In alternative examples, the second conductive members 110 incorporate a vertical component and no angled component. In such alternative examples, the first conductive members may be the first conductive members 106 or 106D, i.e., may or may not incorporate an angled member.

Figure 3E:
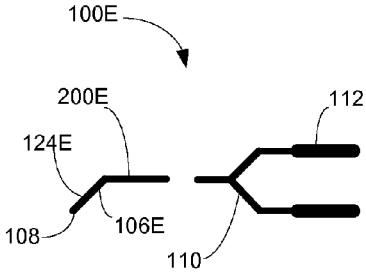

FIG. 3E illustrates a connector assembly 100E with first conductive members 106E having an angled component 124E and a second horizontal component 200E but no or essentially no first horizontal component 122. In such an example, the first end 108 of the first conductive member 106E is at the end of the angled component 124E. As illustrated, the second conductive members 110 are unchanged. In alternative examples, the second conductive members 110 incorporate or do not incorporate first and second horizontal components 216, 218, as appropriate. In such alternative examples, the first conductive members may be the first conductive members 106 or 106E, i.e., may or may not incorporate an angled member.

Figure 3F:
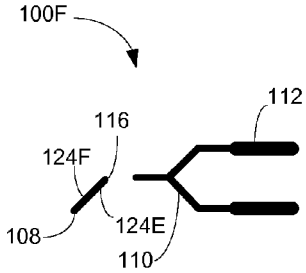

FIG. 3F illustrates a connector assembly 100F with first conductive members 106F having an angled component 124F but no or essentially no first horizontal component 122 or second horizontal component 200. In such an example, the first and second ends 108, 116 of the first conductive member 106F are at the ends of the angled component 124F. As illustrated, the second conductive members 110 are unchanged. In alternative examples, the second conductive members 110 incorporate or do not incorporate first and second horizontal components 216, 218, as appropriate. In such alternative examples, the first conductive members may be the first conductive members 106 or 106F, i.e., may or may not incorporate an angled member.

Figure 4:
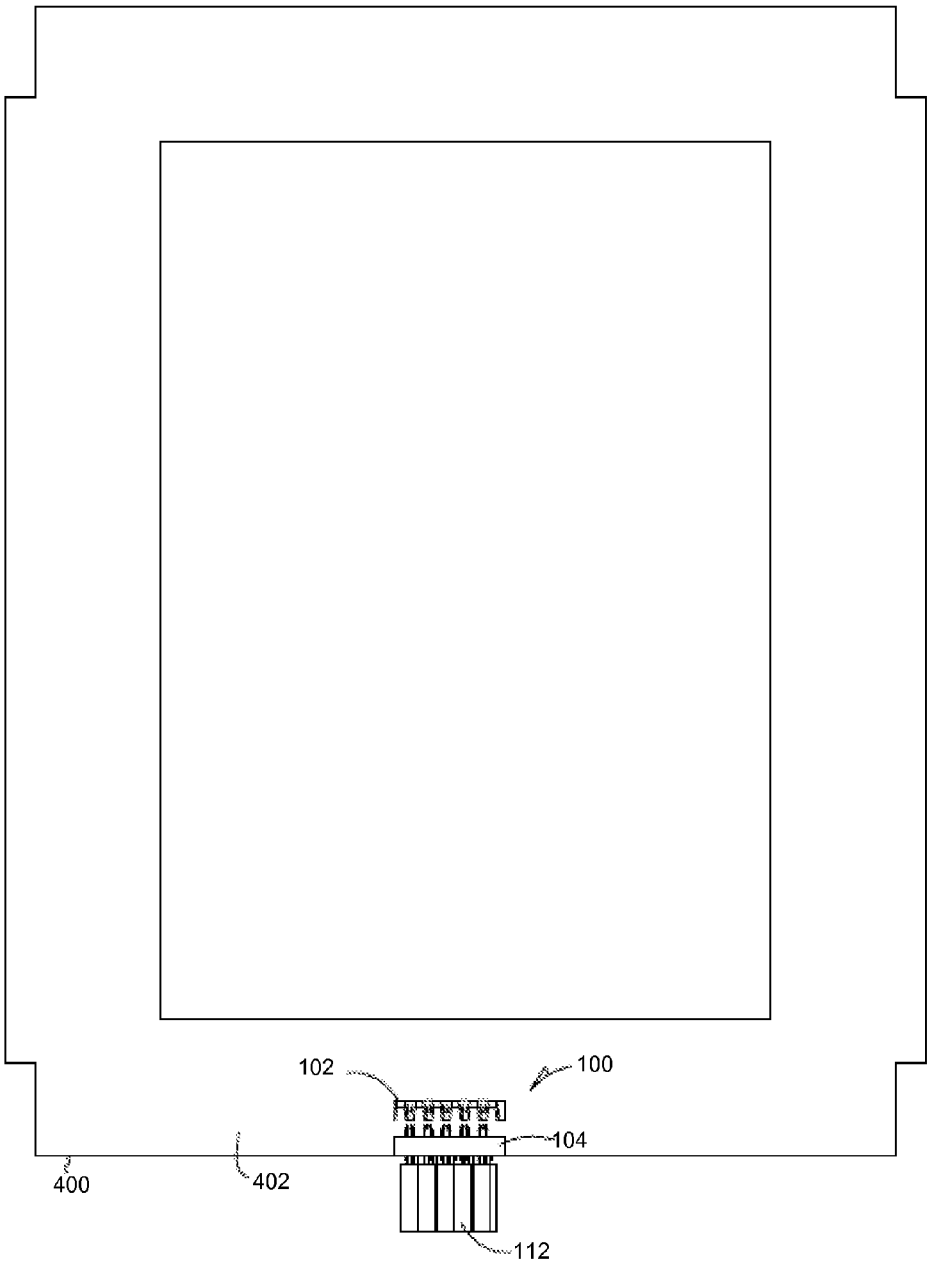
FIG. 4 is an image of a connector assembly on a chip package.

FIG. 4 is a depiction of the connector assembly 100 on a chip package 400. As illustrated, the connector assembly 100 couples to contacts (obscured) on a major surface 402, such as a topside major surface, of the chip package 400. Because of the approximately ninety (90) degree change in direction created by the connector assembly 100, the cables 112 and cable-side connector 104 may plug in to the package-side connector 102 by applying force in a direction generally parallel to a major plane of the major surface 402. The package-side connector 102 may be fixedly coupled to the chip package 400, such as by soldering the first conductive members 106 (obscured) to the contacts (obscured) of the chip package and/or through a mechanical fit, such as a releasable mechanical fit, between the connector 102 and the package 400. In various examples, no enabling mechanism may be needed to maintain the mechanical fit between the connectors 102, 104. Such may be the case because the vertical-to-horizontal translation provided by the connector assembly 100 may reduce mechanical pressure on the junction between the connectors 102, 104 relative to connectors that do not include directional translation.

In various alternative examples, the connector assembly 100 may include a unitary connector that combines the connectors 102, 104 as a single, non-separable piece. In such an example, the connector assembly would still include second conductor members 110 that interface with the cable 112 in multiple rows 208, 210 with a relatively large pitch and form a common row 212 with a smaller pitch, such as approximately one-half the pitch of the rows 208, 210. In such an example, electrical contacts of the cable 112 may be coupled to the connector assembly 100 and/or the connector assembly 100 may be coupled to the chip package 400, in either or both cases either fixedly or removably.

Figure 5:
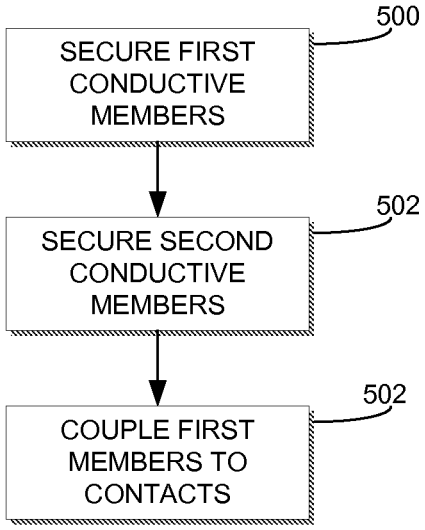
FIG. 5 is a flowchart for making a package.

FIG. 5 is a flowchart for making the connector assembly 100 and components thereof. The flowchart may be applied to the creation of a variety of connectors and connector assemblies in addition to the connector assembly 100. Additionally, the connector assembly 100 and components thereof may alternatively be made according to any of a variety of suitable methods.

At 500, the first plurality of conductive members 106 are secured with respect to one another and form a first row 120. In an example, the first plurality of conductive members 106 are secured in a first connector 102.

At 502, the second plurality of conductive members 110 are secured with respect to one another, a first subset 204 of the second plurality of conductive members 110 forming a second row 208 and a second subset 206 of the second plurality of conductive members 110 different from the first subset 204 forming a third row 210, the second and third rows 208, 210 being parallel and offset with respect to one another. In an example, individual ones of the first and second plurality of conductive members 106, 110 are arranged to be coupled at a first end 108, 114 to a corresponding one of a plurality of contacts. At least one of the first subset 204 and the second subset 206 of the second conductive members 110 has a vertical displacement 224 to form a common row 212 of the second plurality of conductive members 110 at a second end 118 of the second plurality of conductive members 110. Individual ones of the first plurality of conductive members 106 are arranged to be coupled proximate a second end 116 of the first plurality of conductive members 106 to the second end 118 of a corresponding individual one of the second plurality of conductive members 110.

In an example, the second plurality of conductive members 110 are secured in a second connector 104, wherein the first connector 102 is arranged to be secured with respect to the second connector 104 to couple the corresponding individual ones of the first and second plurality of conductive members 106, 110 with respect to one another. In an example, the first connector 102 is arranged to be removably secured with respect to the second connector 104 to removably couple the corresponding individual ones of the first and second plurality of conductive members 106, 110.

In an example, each of the first plurality of conductive members 106 has a vertical displacement 226 from the first end 108 to the second end 116 and wherein the at least one of the first and second subsets 204, 206 of the second plurality of conductive members 110 has a vertical displacement 224 from the first end to the second end 114, 118. In an example, each of the first and second subsets 204, 206 of the second conductive members 110 have a vertical displacement 224 from the first end 114 to the second end 118. In an example, at least one of the first conductive members 106 and the second conductive members 110 include an angled member 124, 214. In an example, a pitch 230 of the second conductive members 110 at the first end 114 is at least twice a pitch 232 of the second conductive members 110 at the second end 118 and at least twice a pitch 228 of the first conductive members 106 at the first end 108.

At 504, the first plurality of conductive members 106 are coupled to contacts on the major surface 402 of the chip package 400.

Figure 6:
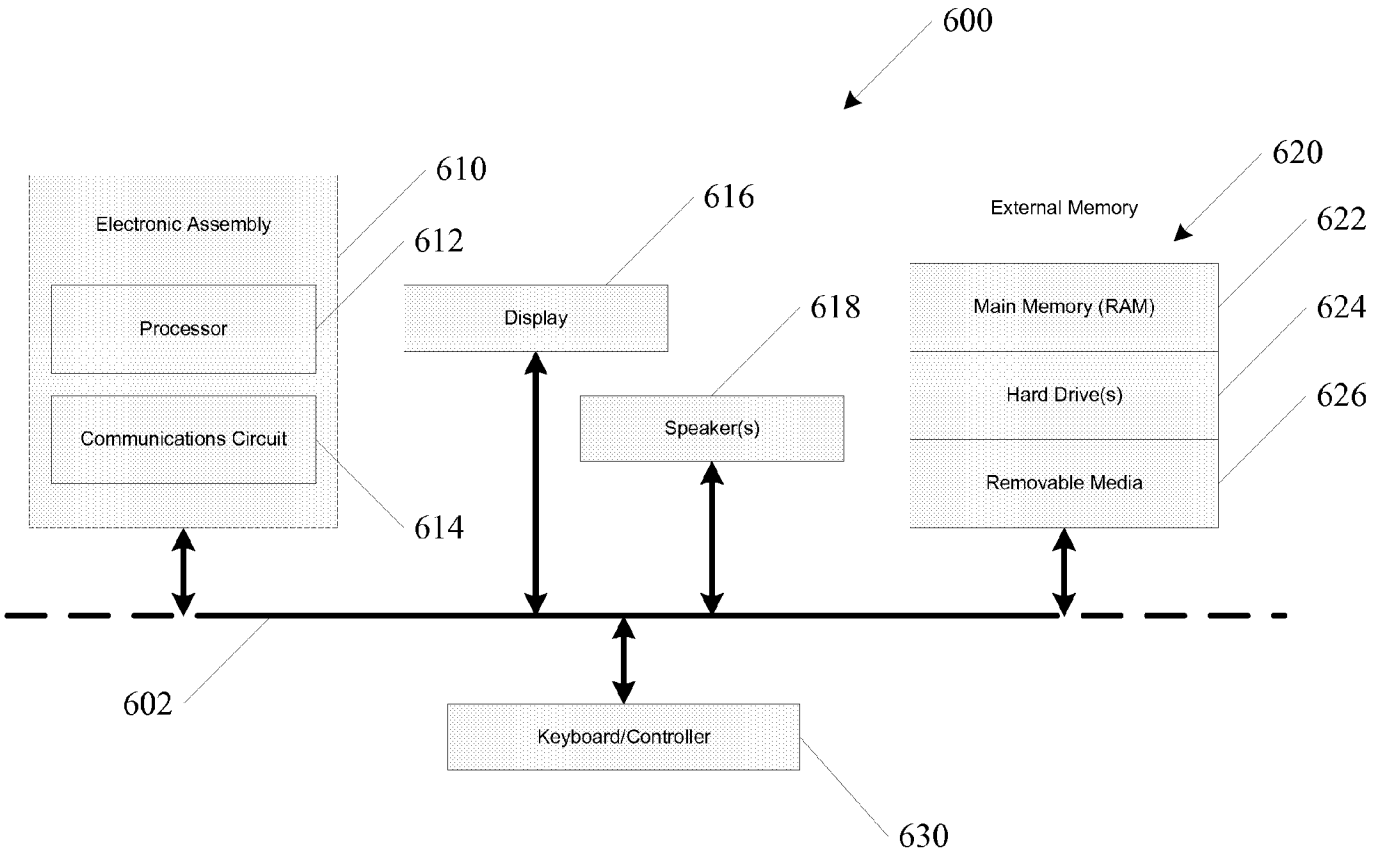
FIG. 6 is a block diagram of an electronic device incorporating at least one package.

An example of an electronic device using semiconductor chips and elongated structures as described in the present disclosure is included to show an example of a higher level device application for the present invention. FIG. 6 is a block diagram of an electronic device 600 incorporating at least one package, such as a package 400 or other package described in examples herein. The electronic device 600 is merely one example of an electronic system in which embodiments of the present invention can be used. Examples of electronic devices 600 include, but are not limited to personal computers, tablet computers, mobile telephones, personal data assistants, MP3 or other digital music players, etc. In this example, the electronic device 600 comprises a data processing system that includes a system bus 602 to couple the various components of the system. The system bus 602 provides communications links among the various components of the electronic device 600 and can be implemented as a single bus, as a combination of busses, or in any other suitable manner.

An electronic assembly 610 is coupled to the system bus 602. The electronic assembly 610 can include any circuit or combination of circuits. In one embodiment, the electronic assembly 610 includes a processor 612 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that can be included in the electronic assembly 610 are a custom circuit, an application-specific integrated circuit (ASIC), or the like, such as, for example, one or more circuits (such as a communications circuit 614) for use in wireless devices like mobile telephones, pagers, personal data assistants, portable computers, two-way radios, and similar electronic systems. The IC can perform any other type of function.

The electronic device 600 can also include an external memory 620, which in turn can include one or more memory elements suitable to the particular application, such as a main memory 622 in the form of random access memory (RAM), one or more hard drives 624, and/or one or more drives that handle removable media 626 such as compact disks (CD), digital video disk (DVD), and the like.

The electronic device 600 can also include a display device 616, one or more speakers 618, and a keyboard and/or controller 630, which can include a mouse, trackball, touch screen, voice-recognition device, or any other device that permits a system user to input information into and receive information from the electronic device 600.

Additional Examples

Example 1 may include subject matter (such as an apparatus, a method, a means for performing acts) that can include a first plurality of conductive members being secured with respect to one another and forming a first row and a second plurality of conductive members being secured with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 2, the connector assembly of Example 1 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

In Example 3, the connector assembly of any one or more of Examples 1 and 2 can optionally further include that the first connector is arranged to be removably secured with respect to the second connector to removably couple the corresponding individual ones of the first and second plurality of conductive members.

In Example 4, the connector assembly of any one or more of Examples 1-3 can optionally further include that each of the first plurality of conductive members has a vertical displacement from the first end to the second end and wherein the at least one of the first and second subsets of the second plurality of conductive members has a vertical displacement from the first end to the second end.

In Example 5, the connector assembly of any one or more of Examples 1-4 can optionally further include that each of the first and second subsets of the second conductive members have a vertical displacement from the first end to the second end.

In Example 6, the connector assembly of any one or more of Examples 1-5 can optionally further include that at least one of the first conductive members and the second conductive members include an angled member.

In Example 7, the connector assembly of any one or more of Examples 1-6 can optionally further include that a pitch of the second conductive members at the first end is at least twice a pitch of the second conductive members at the second end and at least twice a pitch of the first conductive members at the first end.

Example 8 may include subject matter (such as an apparatus, a method, a means for performing acts) that can include a connector for electrically and mechanically coupling to a first plurality of conductive members being secured with respect to one another and forming a first row. The connector can include a second plurality of conductive members being secured with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 9, the connector of Example 8 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

In Example 10, the connector of any one or more of Examples 8 and 9 can optionally further include that the first connector is arranged to be removably secured with respect to the second connector to removably couple the corresponding individual ones of the first and second plurality of conductive members.

In Example 11, the connector of any one or more of Examples 8-10 can optionally further include that each of the first plurality of conductive members has a vertical displacement from the first end to the second end and wherein the at least one of the first and second subsets of the second plurality of conductive members has a vertical displacement from the first end to the second end.

In Example 12, the connector of any one or more of Examples 8-11 can optionally further include that each of the first and second subsets of the second conductive members have a vertical displacement from the first end to the second end.

In Example 13, the connector of any one or more of Examples 8-12 can optionally further include that at least one of the first conductive members and the second conductive members include an angled member.

In Example 14, the connector of any one or more of Examples 8-13 can optionally further include that a pitch of the second conductive members at the first end is at least twice a pitch of the second conductive members at the second end and at least twice a pitch of the first conductive members at the first end.

Example 15 may include subject matter (such as an apparatus, a method, a means for performing acts) that can include a chip package comprising a major surface, a plurality of electrical connects positioned with respect to the major surface, a package connector including a first plurality of conductive members being secured with respect to one another and forming a first row, individual ones of the first plurality of conductive members being coupled to individual ones of the plurality of electrical connects, and a cable connector including a second plurality of conductive members being secured with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 16, the chip package of Example 15 can optionally further include that the package connector is arranged to be removably secured with respect to the cable connector to removably couple the corresponding individual ones of the first and second plurality of conductive members.

In Example 17, the chip package of any one or more of Examples 15 and 16 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 18, the chip package of any one or more of Examples 15-17 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 19, the chip package of any one or more of Examples 15-18 can optionally further include that the second plurality of conductive members are adapted to couple to a plurality of contacts of a cable.

In Example 20, the chip package of any one or more of Examples 15-19 can optionally further include that a pitch of the second conductive members at the first end is at least twice a pitch of the second conductive members at the second end and at least twice a pitch of the first conductive members at the first end.

Example 21 may include subject matter (such as an apparatus, a method, a means for performing acts) that can include a method of making a connector assembly, comprising securing a first plurality of conductive members with respect to one another and forming a first row and securing a second plurality of conductive members with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 22, the method of Example 21 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

In Example 23, the method of any one or more of Examples 21 and 22 can optionally further include that the first connector is arranged to be removably secured with respect to the second connector to removably couple the corresponding individual ones of the first and second plurality of conductive members.

In Example 24, the method of any one or more of Examples 21-23 can optionally further include that each of the first plurality of conductive members has a vertical displacement from the first end to the second end and wherein the at least one of the first and second subsets of the second plurality of conductive members has a vertical displacement from the first end to the second end.

In Example 25, the method of any one or more of Examples 21-24 can optionally further include that each of the first and second subsets of the second conductive members have a vertical displacement from the first end to the second end.

In Example 26, the method of any one or more of Examples 21-25 can optionally further include that at least one of the first conductive members and the second conductive members include an angled member.

In Example 27, the method of any one or more of Examples 21-26 can optionally further include that a pitch of the second conductive members at the first end is at least twice a pitch of the second conductive members at the second end and at least twice a pitch of the first conductive members at the first end.

Example 28 may include subject matter (such as an apparatus, a method, a means for performing acts) that can include a method of making a connector for electrically and mechanically coupling to a first plurality of conductive members being secured with respect to one another and forming a first row. The method may include securing a second plurality of conductive members with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 29, the method of Example 28 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

In Example 30, the method of any one or more of Examples 28 and 9 can optionally further include that the first connector is arranged to be removably secured with respect to the second connector to removably couple the corresponding individual ones of the first and second plurality of conductive members.

In Example 31, the method of any one or more of Examples 28-30 can optionally further include that each of the first plurality of conductive members has a vertical displacement from the first end to the second end and wherein the at least one of the first and second subsets of the second plurality of conductive members has a vertical displacement from the first end to the second end.

In Example 32, the method of any one or more of Examples 28-31 can optionally further include that each of the first and second subsets of the second conductive members have a vertical displacement from the first end to the second end.

In Example 33, the method of any one or more of Examples 28-32 can optionally further include that at least one of the first conductive members and the second conductive members include an angled member.

In Example 34, the method of any one or more of Examples 28-33 can optionally further include that a pitch of the second conductive members at the first end is at least twice a pitch of the second conductive members at the second end and at least twice a pitch of the first conductive members at the first end.

Example 35 may include subject matter (such as an apparatus, a method, a means for performing acts) that can include a method of making a chip package comprising a major surface, a plurality of electrical connects positioned with respect to the major surface. The method comprises securing a first plurality of conductive members in a package connector including with respect to one another and forming a first row, individual ones of the first plurality of conductive members being coupled to individual ones of the plurality of electrical connects, and securing a second plurality of conductive members a cable connector with respect to one another, a first subset of the second plurality of conductive members forming a second row and a second subset of the second plurality of conductive members different from the first subset forming a third row, the second and third rows being parallel and offset with respect to one another. Individual ones of the first and second plurality of conductive members are arranged to be coupled at a first end to a corresponding one of a plurality of contacts. At least one of the first subset and the second subset of the second conductive members has a vertical displacement to form a common row of the second plurality of conductive members at a second end of the second plurality of conductive members. Individual ones of the first plurality of conductive members are arranged to be coupled proximate a second end of the first plurality of conductive members to the second end of a corresponding individual one of the second plurality of conductive members.

In Example 36, the method of Example 35 can optionally further include that the package connector is arranged to be removably secured with respect to the cable connector to removably couple the corresponding individual ones of the first and second plurality of conductive members.

In Example 37, the method of any one or more of Examples 35 and 36 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 38, the method of any one or more of Examples 35-37 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 39, the method of any one or more of Examples 35-38 can optionally further include that the second plurality of conductive members are adapted to couple to a plurality of contacts of a cable.

In Example 40, the method of any one or more of Examples 35-39 can optionally further include that a pitch of the second conductive members at the first end is at least twice a pitch of the second conductive members at the second end and at least twice a pitch of the first conductive members at the first end.

Each of these non-limiting examples can stand on its own, or can be combined with one or more of the other examples in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A connector assembly, comprising:

a first plurality of conductive members being secured with respect to one another and forming a first row; and a second plurality of conductive members being secured with respect to one another, a first subset of the second plurality of conductive members forming a second row and a second subset of the second plurality of conductive members different from the first subset forming a third row, the second and third rows being parallel and offset with respect to one another;

wherein individual ones of the first and second plurality of conductive members are arranged to be coupled at a first end to a corresponding one of a plurality of contacts;

wherein at least one of the first subset and the second subset of the second conductive members has a vertical displacement to form a common row of the second plurality of conductive members at a second end of the second plurality of conductive members; and wherein individual ones of the first plurality of conductive members are arranged to be coupled proximate a second end of the first plurality of conductive members to the second end of a corresponding individual one of the second plurality of conductive members.

2. The connector assembly of claim 1, wherein the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

3. The connector assembly of claim 2, wherein the first connector is arranged to be removably secured with respect to the second connector to removably couple the corresponding individual ones of the first and second plurality of conductive members.

4. The connector assembly of claim 1, wherein each of the first plurality of conductive members has a vertical displacement from the first end to the second end and wherein the at least one of the first and second subsets of the second plurality of conductive members has a vertical displacement from the first end to the second end.

5. The connector assembly of claim 4, wherein each of the first and second subsets of the second conductive members have a vertical displacement from the first end to the second end.

6. The connector assembly of claim 4, wherein at least one of the first conductive members and the second conductive members include an angled member.

7. The connector assembly of claim 1, wherein a pitch of the second conductive members at the first end is at least twice a pitch of the second conductive members at the second end and at least twice a pitch of the first conductive members at the first end.

8. A connector for electrically and mechanically coupling to a first plurality of conductive members being secured with respect to one another and forming a first row, comprising:

a second plurality of conductive members being secured with respect to one another, a first subset of the second plurality of conductive members forming a second row and a second subset of the second plurality of conductive members different from the first subset forming a third row, the second and third rows being parallel and offset with respect to one another;

wherein individual ones of the first and second plurality of conductive members are arranged to be coupled at a first end to a corresponding one of a plurality of contacts;

wherein at least one of the first subset and the second subset of the second conductive members has a vertical displacement to form a common row of the second plurality of conductive members at a second end of the second plurality of conductive members; and wherein individual ones of the first plurality of conductive members are arranged to be coupled proximate a second end of the first plurality of conductive members to the second end of a corresponding individual one of the second plurality of conductive members.

9. The connector of claim 8, wherein the first plurality of conductive members are secured in a first connector and the second plurality of conductive members are secured in a second connector, wherein the first connector is arranged to be secured with respect to the second connector to couple the corresponding individual ones of the first and second plurality of conductive members with respect to one another.

10. The connector of claim 9, wherein the first connector is arranged to be removably secured with respect to the second connector to removably couple the corresponding individual ones of the first and second plurality of conductive members.

11. The connector of claim 8, wherein each of the first plurality of conductive members has a vertical displacement from the first end to the second end and wherein the at least one of the first and second subsets of the second plurality of conductive members has a vertical displacement from the first end to the second end.

12. The connector of claim 11, wherein each of the first and second subsets of the second conductive members have a vertical displacement from the first end to the second end.

13. The connector of claim 11, wherein at least one of the first conductive members and the second conductive members include an angled member.

14. The connector of claim 8, wherein a pitch of the second conductive members at the first end is at least twice a pitch of the second conductive members at the second end and at least twice a pitch of the first conductive members at the first end.

15. A chip package, comprising:

a major surface;

a plurality of electrical connects positioned with respect to the major surface; and a package connector including a first plurality of conductive members being secured with respect to one another and forming a first row, individual ones of the first plurality of conductive members being coupled to individual ones of the plurality of electrical connects; and a cable connector including a second plurality of conductive members being secured with respect to one another, a first subset of the second plurality of conductive members forming a second row and a second subset of the second plurality of conductive members different from the first subset forming a third row, the second and third rows being parallel and offset with respect to one another;

wherein individual ones of the first and second plurality of conductive members are arranged to be coupled at a first end to a corresponding one of a plurality of contacts;

wherein at least one of the first subset and the second subset of the second conductive members has a vertical displacement to form a common row of the second plurality of conductive members at a second end of the second plurality of conductive members; and wherein individual ones of the first plurality of conductive members are arranged to be coupled proximate a second end of the first plurality of conductive members to the second end of a corresponding individual one of the second plurality of conductive members.

16. The chip package of claim 15, wherein the package connector is arranged to be removably secured with respect to the cable connector to removably couple the corresponding individual ones of the first and second plurality of conductive members.

17. The chip package of claim 15, wherein each of the first plurality of conductive members has an interface surface at which the first plurality of conductive members couples to the second plurality of conductive members, and wherein the first plurality of conductive members comprise:

a first subset of conductive members having a first length from the first end to the interface surface; and a second subset of conductive members having a second length from the first end to the interface surface, the second length being shorter than the first length.

18. The chip package of claim 15, the second plurality of conductive members are adapted to couple to a plurality of contacts of a cable.

19. The chip package of claim 15, wherein a pitch of the second conductive members at the first end is at least twice a pitch of the second conductive members at the second end and at least twice a pitch of the first conductive members at the first end.

* * * * *